United States Patent [19]

Anderson et al.

[11] Patent Number: 4,748,743

[45] Date of Patent: Jun. 7, 1988

[54] UTILITY KNIFE WITH IMPROVED BLADE LOCKING FEATURE

[76] Inventors: Lloyd E. Anderson, 6408 - 74th Ave. N.; Martin L. Anderson, 4417 Third St. N.E., both of Minneapolis, Minn. 55428

[21] Appl. No.: 2,561

[22] Filed: Jan. 12, 1987

[51] Int. Cl.[4] ..... B26B 3/06

[52] U.S. Cl. ..... 30/162; 30/151

[58] Field of Search ..... 30/162, 161, 151, 164

[56] References Cited

U.S. PATENT DOCUMENTS

| | | | |
|---|---|---|---|
| 4,068,375 | 1/1978 | Rathbun et al. | 30/162 X |
| 4,139,939 | 2/1979 | Crouks | 30/162 X |
| 4,389,776 | 6/1983 | Okada | 30/162 |

*Primary Examiner*—E. R. Kazenske

*Assistant Examiner*—Willmon Fridie, Jr.

*Attorney, Agent, or Firm*—Orrin M. Haugen; Thomas J. Nikolai; Frederick W. Niebuhr

[57] ABSTRACT

A utility knife of the type having a replaceable blade held in a blade holder and used for cutting carpeting, trimming wallpaper and other related uses. The blade holder comprises a handle which can be gripped when using the tool, the handle including an internal recess for containing the blade as well as a slide member having dove-tail edges cooperating with a tapered guideway and a thumb grip on the slide member projects through an opening in the handle to allow the user to readily move the slide member. The cooperation between the dove-tail edges on the slide member and the tapered guideway causes a clamping force to be imparted to the blade, locking it in a desired preset position.

8 Claims, 1 Drawing Sheet

UTILITY KNIFE WITH IMPROVED BLADE LOCKING FEATURE

BACKGROUND OF THE INVENTION

I. Field of the Invention:

This invention relates generally to a cutting tool, and more particularly to a so-called "utility knife" of the type incorporating a replaceable blade supported in a gripping handle and wherein the length of the blade extending beyond the end of the handle can be infinitely adjusted and then locked in a preset position.

II. Discussion of the Prior Art:

Various forms of utility knives are known in the prior art. They generally comprise a blade which can be clamped or gripped in a handle and used for cutting a variety of items including carpeting, cardboard, vinyl and cloth fabircs, trimming wallpaper, etc. When the blade becomes dulled by such use, it is taken out, discarded and replaced with a new blade. One well-known utility knife is that manufactured by the Stanley Tool Co. and it comprises a flat, trapezoidally-shaped blade having a pattern of notches in one side edge thereof, the blade being contained within a two-piece handle, the pieces of the handle being held together by a suitable fastener and the blade being locked against movement by virtue of a suitably positioned projection which engages the notches on the blade.

Another form of utility knife is disclosed in the Anderson et al U.S. Pat. No. 4,109,380 which has been assigned to the assignee of the present invention. That knife comprises a generally rectangular blade whose two opposed side edges are each honed to a fine cutting edge and which does not rely upon notches formed in the blade to hold it fixed relative to its handle. Instead, the slit where the blade exits the end edge of the blade holder is provided with a predetermined taper at its edges and the length of the slit is slightly greater than the width of the blade. Hence, when a cutting force is applied to the blade by pressing it against the item to be cut, the blade cocks in its handle and the cutting edge becomes wedged in the tapered end of the slit formed in the end of the handle. This wedging action prevents longitudinal movement of the blade relative to the handle.

Another utility knife now on the market is manufactured by Kimkead and sold under its trademark "KINYRIM". This utility knife also includes a blade holder in the form of a handle having a goose-neck head quite similar in construction to the embodiment shown in FIG. 9 of the aforereferenced Anderson patent. In this arrangement, a blade having a longitudinally extending slot fits between the separable halves of the blade holder and a screw passes through one side of the knife handle, through the slot in the blade and into a threaded bore formed in the other handle half. By tightening this screw, a clamping force is applied to the blade. Slotted blades of the type described do not stand up as well in use especially when significant pressure must be applied to the item being cut. The longitudinal slot necessarily weakens the blade and breakage often occurs.

SUMMARY OF THE INVENTION

The utility knife of the present invention comprises a generally rectangular, unslotted blade having two opposed longitudinal edges honed to razor-sharpness and a blade holder in the form of a gripping handle along with means for releaseably locking the blade relative to the handle. The blade holder includes first and second handle halves which, when joined together, may readily and comfortably be gripped in the hand of the user. The first handle half includes an elongated slot formed therethrough and the second handle half has a shallow recess being slightly greater than the thickness dimension of the blade used with the knife. Integrally formed with or otherwise attached to the first handle half are first and second guideways, each having an edge extending diagonally across the edges defining the shallow recess, the edges of the guideways having an outwardly and downwardly tapered surface relative to a central axis of the blade holder. A generally flat slide member whose opposed side edges are tapered correspondingly with the taper of the first and second guideways is fitted into the guideways such that its tapered edges engage in dove-tail relation with the guideways. Also formed on the slide member is a thumb grip which projects through the elongated slot formed in the first handle half. By using the thumb to pull against the thumb grip, the slide member may be moved and because of the cooperation between the outwardly and downwardly tapered surfaces of the guideways and the correspondingly tapered edges of the slide member, a squeezing force is developed which pushes the blade against the base of the shallow recess in which the blade is contained. The extent to which the blade may project out of the end portion of the blade holder can readily be adjusted by appropriately manipulating the slide member. specifically, when the thumb is used to urge the slide member in a forward direction, the blade is released and can be repositioned or completely removed and reversed to expose unused blade surface. Then, by merely drawing back on the thumb grip in a rearward direction, the blade again becomes wedged in the handle, ready for use. A further hollowed-out recess formed on the interior surface of the handle halves provides a convenient storage chamber within the handle for replacement blades.

OBJECTS

It is accordingly a principal object of the present invention to provide a new and improved workmen's utility knife.

Another object of the invention is to provide a utility knife which allows continuous adjustment of the amount of blade projecting from the end of the blade holder.

Still another object of the invention is to provide a utility knife which allows the blade to be removed and reversed without having to disassemble the blade handle.

A yet further object of the invention is to provide a utility knife which can be manufactured at low cost but which is sufficiently rugged to provide long life even under the most severe handling.

A yet still further object of the invnetion is to provide a utility knife in which an unslotted blade is positively gripped in the blade holder, thus making it safe to use and without fear of blade slippage and with reduced incidences of blade breakage.

Still another object of the invention is to provide a utility knife in which the blade can readily be released allowing the blade to be retracted into the handle to protect the blade when not in use.

These and other objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
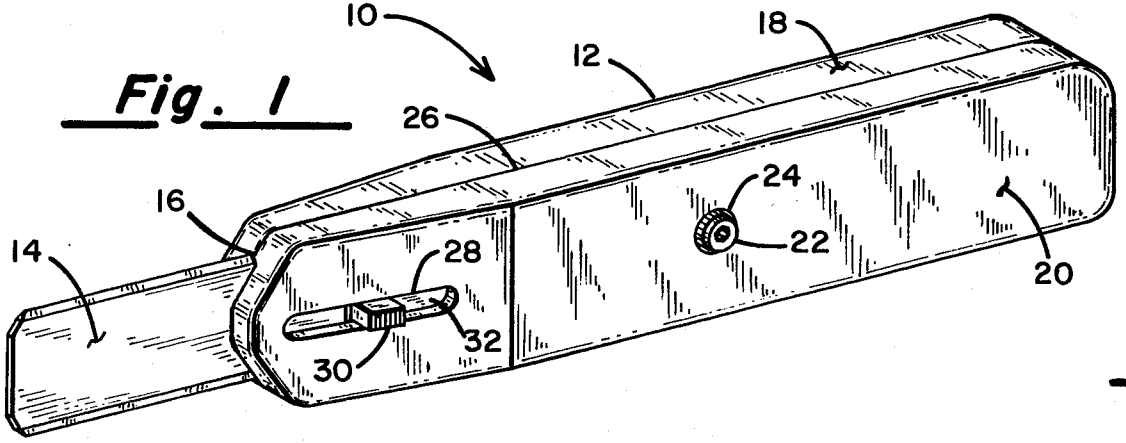
FIG. 1 is a perspective view of the utility knife of the present invention.

Referring first to FIG. 1, there is shown a perspective view of the utility knife in accordance with the present invention. The utility knife, as indicated generally by numeral 10, is seen to comprise a blade holder 12 and a cutting blade 14 which is preferably generally rectangular and which can be made to project outwardly from the forward end 16 of the blade holder 12.

The blade holder 12 comprises a first handle half 18 and a second handle half 20 which are held together by a suitable fastening means, such as a cap screw 22, which passes through a circular opening 24 in the handle half 20 and into a threaded bore which is hidden from view in the perspective view of FIG. 1. The handle halves come together along a central plane 26 which passes through the blade 14.

Formed through the thickness dimension of the handle half 20 is a longitudinally extending slot 28 and projecting outwardly therefrom is a thumb grip member 30 which is attached to a slide member 32.

The handle halves 18 and 20 may be fabricated from any suitable materials, such as metal, plastic or wood, and, in the case of metal and plastic can be readily manufactured in a molding process. When the parts are assembled as shown in the perspective view of FIG. 1, the upper and lower side edges are smoothly rounded while the opposed exterior side surfaces are relatively flat. The blade holder is preferably of a length to fit comfortably in the palm of the hand with the fingers wrapped about it and with the user's thumb ending just short of the forward end 16 of the blade holder.

Figure 2:
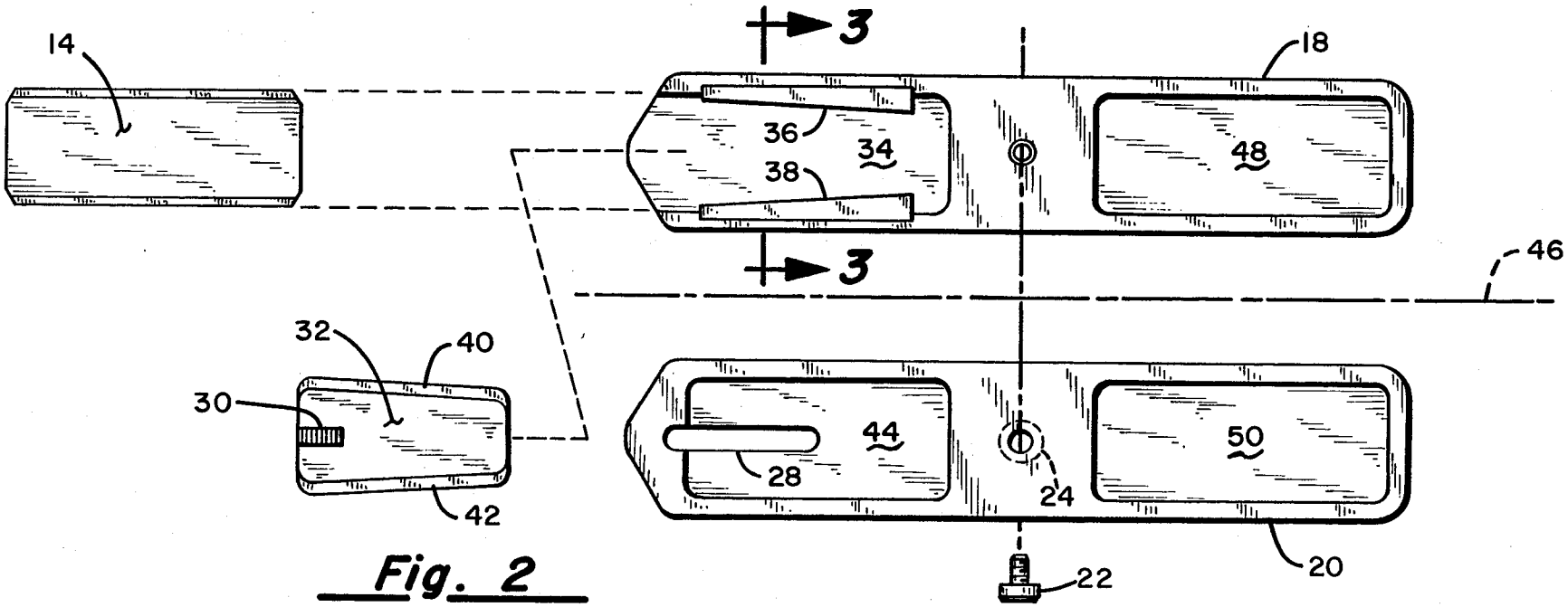
FIG. 2 is an exploded plan view showing the interior construction of the blade holder.

Referring next to the blown-apart plan view of FIG. 2, the blade holder 10 is shown in its opened condition whereby the interior surfaces features thereof can be viewed. The interior surface of handle half 18 has a shallow recess 34 formed therein, the depth of the recess being only slightly larger than the thickness dimension of the blade 14. The overall length and width of the recess 34 is such that the blade 14 can fit substantially entirely within it when the blade is retracted.

Figure 3:
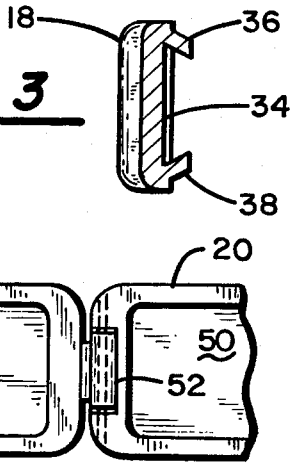
FIG. 3 is a cross-sectional view taken along the lines 3—3 in FIG. 2.
Figure 4:
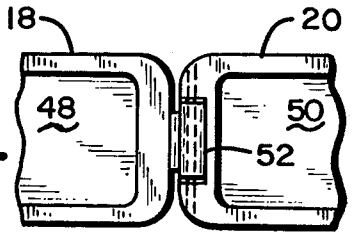
FIG. 4 is a partial view of a handle design where the two handle halves are hinged together at the butt end of the tool.

Extending diagonally across the longitudinal edges defining the recess 34 first and second guideways 36 and 38. As can best be viewed in the cross-sectional view of FIG. 3, the guideways 36 and 38 are provided with an outwardly and downwardly tapered surface relative to a central longitudinal axis of the blade holder.

Shown immediately to the left of the handle half 18 is the slide member 32 and it is seen to comprise a generally flat plate whose side edges 40 and 42 are tapered with the angle of taper corresponding to that of the first and second guideways 36 and 38. Thus, when the slide member 32 is fitted into the guideways 36 and 38 and moved to the right when viewed as in FIG. 2, the tapered surfaces 40 and 42 become dove-tailed with the mating tapered surfaces of the guideways 36 and 38.

With continued reference to FIG. 2, the handle half 20 is also provided with a generally rectangular recess 44 of a depth which can accommodate the height dimension of the guideways 36 and 38 therein. Thus, when the blade 14 is fitted into the recess 34 and the slide member 32 is loosely inserted such that the tapered surfaces 40 and 42 fall beneath the correspondingly tapered surfaces of the guideways 36 and 38, the handle half 20 may be folded about the line 46 and the guideways 36 and 38 will fit within the rectangular recess 44 while the thumb grip member 30 projects out through the elongated slot 28 and is engageable with the user's thumb. The user can now pull the blade 14 out to a desired extent and then by pulling rearward on the thumb grip member 30, the slide 32 will wedge tightly against the blade and squeeze the blade against the bottom of the recess 34 due to the action of the dove-tailed engagement between the tapered surfaces 40 and 42 on the slide member and the tapered surface on the guideways 36 and 38. Because the locking arrangement does not depend upon a screw passing through the blade, there is no need to use the usual slotted blade. When it is desired to either adjust the amount of extension of the blade 14 from the blade holder 12, the user merely pushes forward against the thumb grip member 30 to urge the slide member 32 to the left when viewed as in FIG. 1, which releases the wedging action between the slide member 32 and the blade 14. When so released, the user may either adjust the amount of blade extending, retract the blade totally within the handle for storage or, alternatively, he or she may remove the blade completely and turn it end-for-end and replace it within the blade holder to provide the user with unused blade surface.

As can further be seen from the blown-apart view of FIG. 2, further recesses 48 and 50 are formed in the handle halves 18 and 20, respectively. These recesses may be fairly deep and provide a convenient place where and additional supply of new blades may be stored until they are to be used. To gain access to the blades contained in the storage compartment defined by the recesses 48 and 50, the user need only remove the screw 22 to allow the handle halves to be separated.

It is also contemplated that the handle halves 18 and 20 may be joined at their butt end by means of a hinge 52 so that when the screw 22 is removed, the handle half 50 may be rotated relative to the handle half 48 to expose the interior of the utility knife 10 while not allowing them to separate. In that the two handle halves stay together, it is unlikely that any of the parts will slip out of the user's hand when he is retrieving a new blade from the storage compartment of the like.

In that the length of the recess 34 can be dimensioned so that when the blade 14 is fully retracted therein, at least a small corner portion of the blade 14 extends beyond the end 16 of the blade holder, there is no need to provide the usual longitudinal slot in the blade 14 into which another tool can be inserted for pushing the blade outwardly relative to the end 16 of the blade holder 12. In that the need for the slot of opening in the blade 14 can be eliminated, it allows for a more rigid blade which is less subject to cracking or breaking if a substantial pressure is applied to the blade during the cutting operation.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. In a utility knife of the type having a flat replaceable blade and a blade holder in the form of a gripping handle, means for releaseably locking said first blade in a preset position relative to the handle, the improvement comprising:

(a) a blade holder including first and second handle halves, said first handle half including an elongated slot formed therethrough and an interior surface, said second handle half having a shallow recess formed in an interior surface thereof defining parallel longitudinal edges;

(b) first and second guideways attached to said second handle half, each guideway extending diagonally across said longitudinal edges defined by said shallow recess in said second handle half, said guideways having surfaces which are tapered outwardly and downwardly relative to a central longitudinal axis of said blade holder;

(c) a generally flat slide member having opposed edges which are tapered correspondingly with the taper of said first and second guideways so as to be receivable therein in dove-tail relation, said slide member including a thumb grip projecting outwardly from a side surface and through said elongated slot formed in said first handle half whereby movement of said slide member in a first direction upon application of force to said thumb grip member applies a squeezing force to said blade against the bottom of said shallow recess.

2. The utility knife as in claim 1 wherein said blade is generally rectangular.

3. The utility knife as in claim 2 wherein said shallow recess extends longitudinally inwardly from one end of said second handle half, the recess being of a length and width slightly greater than the length and width dimension of the generally rectangular blade.

4. The utility knife as in claim 1 wherein said first and second handle halves are held together by fastening means.

5. The utility knife as in claim 1 wherein said first and second handle halves are held together by hinge means disposed at the butt end of said first and second handle halves.

6. The utility knife as in claim 1 wherein said blade is double-edged and unslotted.

7. The blade holder as in claim 1 wherein the depth of said shallow recess is slightly greater than the thickness dimension of said blade.

8. The blade holder as in claim 1 and further including a recess formed inwardly of the interior surface of said first handle half sufficiently deep to receive said first and second guideways and said slide member therein.

* * * * *